United States Patent [19]

Weisbeck

[11] 4,440,052

[45] Apr. 3, 1984

[54] PUNCH ASSEMBLY WITH UNITARY STRIPPER SPRING ASSEMBLY

[75] Inventor: Ralph L. Weisbeck, Williamsville, N.Y.

[73] Assignee: Unipunch Products, Inc., Buffalo, N.Y.

[21] Appl. No.: 186,430

[22] Filed: Sep. 12, 1980

[51] Int. Cl.[3] ..... B21D 45/04; B26F 1/14

[52] U.S. Cl. ..... 83/140; 83/640; 83/700

[58] Field of Search ..... 83/140, 139, 136, 138, 83/141, 640, 700

[56] References Cited

U.S. PATENT DOCUMENTS

| | | | |
|---|---|---|---|
| Re. 29,950 | 4/1979 | Bartha . | |
| Re. 29,958 | 4/1979 | Cady . | |
| 1,723,935 | 8/1929 | Henricson | 83/140 |
| 1,986,036 | 1/1935 | Whistler | 83/140 |
| 2,013,976 | 9/1935 | Wales . | |
| 2,225,342 | 12/1940 | Hyatt | 83/136 |
| 2,268,787 | 1/1942 | Wales | 83/140 |
| 2,355,344 | 8/1944 | Wales . | |
| 2,579,641 | 12/1951 | Aldrich | 83/140 |
| 3,114,280 | 12/1963 | Schott . | |
| 3,481,236 | 12/1969 | Nicklasson | 83/140 |
| 4,141,264 | 2/1979 | Weisbeck | 83/140 X |
| 4,375,774 | 3/1983 | Wilson et al. | 83/140 |

*Primary Examiner*—Frank T. Yost

*Attorney, Agent, or Firm*—Banner, Birch, McKie & Beckett

[57] ABSTRACT

A punch assembly for punching a workpiece comprising a unitary stripper spring assembly that can be adjustably fastened to a punch. The unitary stripper spring assembly includes a threaded head which engages a threaded end of the punch so the effective length of the punch can be varied after sharpening by simply turning the unitary stripper spring assembly relative to the punch. The punch is fastened to the unitary stripper spring assembly only at the head. The unitary stripper spring assembly further includes a washer, and a telescopic retainer enclosed in a stripper spring between the head and the washer. The telescopic retainer responds to the force exerted on the punch assembly by the ram of a punching device by contracting during the punching stroke. After the punching stroke the stripper spring expands to strip the punch from the workpiece and the stripper spring assembly returns to its normal position. The unitary stripper spring assembly forms a discrete and integral mechanism independent of the punch. The punch assembly of the present invention achieves a simple one step adjustment of the effective punch length without the use of special tools or any disassembly of the unitary stripper spring assembly, even after repeated sharpening of the punch. Also, a punch guide having a retainer device for attaching the punch guide to the punch forms part of the present invention.

21 Claims, 7 Drawing Figures

PUNCH ASSEMBLY WITH UNITARY STRIPPER SPRING ASSEMBLY

BACKGROUND OF THE INVENTION

1. Field of the Invention

The present invention relates to an improved punch assembly, including a punch, stripper spring assembly, and punch guide for use in a punching machine.

2. Prior Art

In high speed punching machines, it is desirable to maintain the shortest punching stroke possible because a long punching stroke increases the time required to punch a hole, thereby decreasing the productivity of the punching machine. In addition, the longer stroke causes greater compression of the stripper spring, which shortens its life because it is subjected to greater flexing. To shorten the punching stroke, it is desirable to maintain the top of the punch assembly as close to the ram as possible, and to maintain the extreme bottom end, that is, the cutting end of the punch, as nearly flush with the bottom of the punch guide as possible. At the same time, the overall length of the entire punch assembly must be maintained within small tolerances to keep the top of the punch assembly from striking the ram laterally as the turret rotates.

After a period of use, the cutting end of the punch wears and must be sharpened by grinding. Sharpening shortens the punch, which undoes the flush relationship between the cutting end of the punch and the end of the punch guide. To reestablish the flush relationship, the punch must be sharpened and readjusted to proper length.

When great numbers of punches are employed in many punching machines, much time and labor must be expended to sharpen and otherwise maintain the punches. Punches that can be sharpened only once or twice, as is the case in nearly all the prior art, must be discarded after a relatively short useful like. Also, the punch and stripper spring assemblies of the prior art are attached together in a manner that requires complete disassembly of the stripper spring assembly in order to remove the punch. Disassembly of the stripper spring assembly is tedious, time consuming, and frequently requires the use of special tools.

The prior art attempts to solve the above disadvantages have not been entirely successful. For example, in U.S. Pat. No. Re 29,958 issued to Cady on Apr. 10, 1979, a punch assembly is disclosed having a punch with an adjustable length through use of a reversible split ring retainer having a lip on one side. The split ring retainer is placed between the stripper string and a fixed shoulder on the punch. Before the punch has been sharpened, the side of the split ring retainer without the lip bears against the shoulder of the punch; the lip extends into an enlarged bore in a washer mounted on the other side of the retainer to effectively eliminate the width dimension of the lip. After the punch has been sharpened, the split ring retainer is reversed so the lip effectively compensates for the ground off portion of the punch.

The above technique for adjusting the effective length of the punch has several disadvantages. The required disassembly of the punch and stripper spring assembly to reverse the split ring retainer is an inefficient and cumbersome procedure. The lip of the split ring retainer also is very fragile and must be short to sustain punching forces, thus severely limiting the amount the punch can be lengthened. In addition, the punch can be sharpened only once and the amount of adjustment is fixed according to the dimension of the short lip, which may not correspond precisely with the length lost through sharpening.

In U.S. Pat. No. 4,141,264 issued to Weisbeck on Feb. 27, 1979, a punch assembly is disclosed that permits the punch to be sharpened a greater number of times to prolong the life of the punch. Two adjustments are required. First, after sharpening, one or more retainer shims approximately 1/16th of an inch thick are driven over the bottom portion of the punch until they seat above a shoulder in the punch. Second, the position of the head of the stripper spring assembly, which is threaded onto the top end of the punch, is adjusted on the punch. These two adjustments maintain the same effective length of the punch and the same tension on the stripper spring. This technique for adjusting the effective length of the punch is, however, awkward and cumbersome. Adjustments can be made only in discrete amounts and the retainer shims are not sturdy enough to withstand sustained punching. The amount of adjustment is limited by the weakness of multiple retainer shims. Also, replacement of a punch requires complete disassembly of the punch assembly. Finally, the critical overall length of the punch assembly requires exacting readjustment of the length of the stripper spring assembly. If the stripper spring assembly is only slightly too long, it will strike the ram laterally when the turret rotates, which can severely damage the punching device.

Finally in U.S. Pat. No. 2,355,344 issued to Wales on Sept. 10, 1935, a punch assembly is disclosed having a punch whose length is adjustable by turning nuts threaded onto the top portion of the punch. These nuts are separate from the stripper spring assembly so the punch itself is not fastened or attached to the stripper spring assembly. By providing a punch that is not fastened to the stripper spring assembly, the punch can be easily removed for sharpening and the central stripper spring, which is not a fixed part of the stripper spring assembly, can be easily replaced. The Wales punch requires a bulky and cumbersome stripper spring assembly which severely limits the usefulness of this punch and stripper spring assembly in modern high speed punching machines. Furthermore, since the punch is not fastened to the stripper spring assembly, it would vibrate excessively when subjected to the rapid and sustained impact of a modern punch press.

SUMMARY OF THE INVENTION

Accordingly, it is an object of the present invention to provide a punch assembly having a punch that can be easily and readily sharpened to avoid any significant reduction in the productivity of the punch press. A related object is to provide a punch that can be repeatedly sharpened to greatly increase the useful life of the punch. In this regard, it is an object of the present invention to provide a punch assembly for a high speed punching device in which the position of the punch can be readily and continuously adjusted throughout a greater range than generally achieved in the prior art.

Another object of the present invention is to provide a punch assembly having a unitary stripper spring assembly consisting of a discrete and integral assembly independent of the punch.

Another object of the present invention is to provide a punch assembly having a unitary stripper spring assembly of fixed and constant length which maintains a constant predetermined tension on the stripper spring. The predetermined tension on the stripper spring prevents excess vibration during punching, extends the life of the stripper spring, and reduces maintenance cost.

Another object of the present invention is to provide a unitary stripper spring assembly of fixed and constant length that will maintain the exact height of the punch assembly above the workpiece to eliminate the possibility that the punch assembly will strike the ram when the turret rotates. The constant length of the stripper spring means, which needs no readjustment, prevents operator error that frequently occurs when the length of stripper spring assemblies is manually re-set after sharpening.

Another object of the present invention is to provide a punch assembly including a unitary stripper spring assembly that can be readily and conveniently fastened to the punch without requiring any disassembly of the stripper spring assembly.

Another object of the present invention is to provide a punch assembly having a punch that is stronger, longer lasting, and less expensive to manufacture than punches of the prior art because the punch contains fewer and smaller grooves and detents.

Another object of the present invention is to provide a punch assembly having a punch guide with a retainer device to prevent detachment of the punch guide from the punch during use. The retainer device of the present invention is more reliable and durable than those known to the prior art. The retainer device permits easier assembly and removal of the punch guide and punch than those known to the prior art, while maintaining a firm connection between the punch and punch guide. In addition, the retaining means of the present invention requires no change in the conventional taper toward the cutting end of a punch.

Another object of the present invention is to provide a punch assembly including a stripper spring assembly, a punch, and a punch guide that is relatively simple and inexpensive to manufacture and requires a minimum number of replacement parts.

A further object of the present invention is to provide a punch assembly including a unitary stripper spring assembly, a punch, and a punch guide that minimizes labor and time involved in maintenance and repair by permitting ready replacement of the stripper spring assembly, the punch, or the punch guide independently of one another.

According to the present invention, a punch assembly is provided wherein a unitary stripper spring assembly comprises an integral and discrete assembly separate and apart from the punch. The stripper spring assembly is readily and adjustably fastenable to the punch. In particular the punch includes a punching end for punching a workpiece and a fastening end. The unitary stripper spring assembly, which strips the punch from the workpiece, is fastened to the fastening end of the punch. The stripper spring assembly includes a threaded head which is adjustably fastened on the fastening end or threaded end of the punch. The punch assembly also includes a punch guide encircling the punching end of the punch for guiding the punch toward the workpiece. The punch guide includes a retainier device coactive with a detent on the punch for retaining the punch guide means on the punch.

Many other advantages, features, and additional objects of the present invention will become apparent from the detailed description and accompanying drawings, in which preferred structural embodiments incorporating the principles of the present invention are shown by way of illustration.

DETAILED DESCRIPTION OF THE PREFERRED EMBODIMENT

Figure 3:
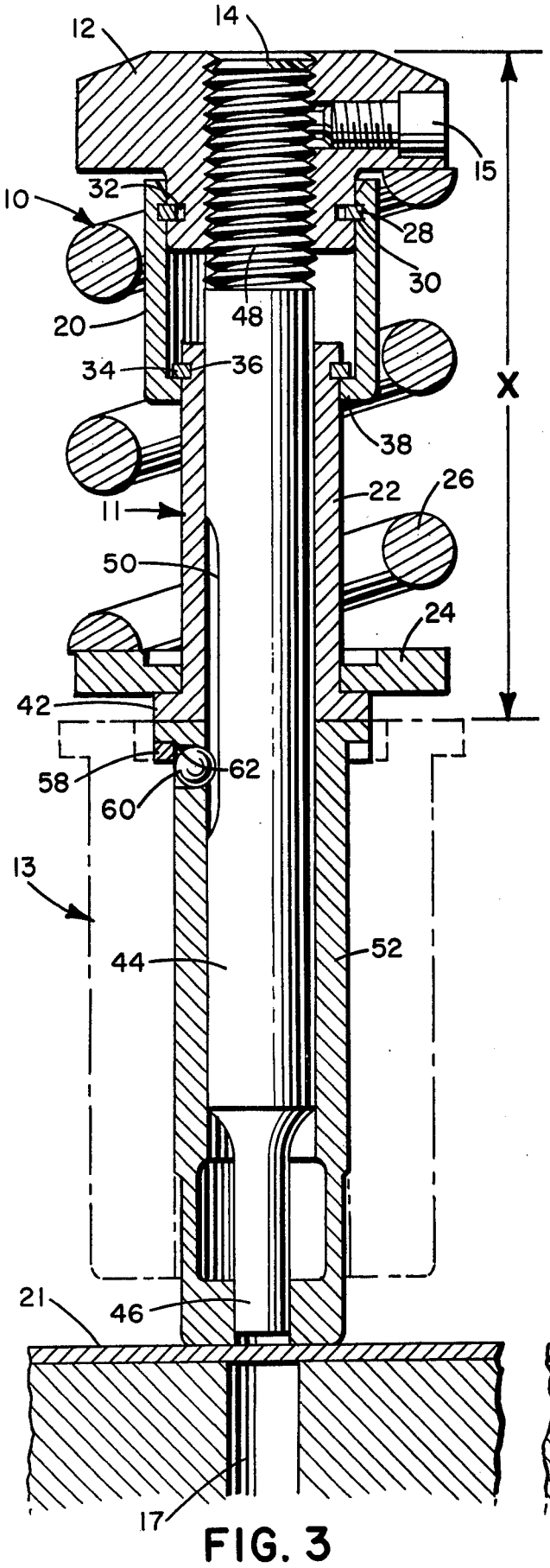
FIG. 3 is a vertical longitudinal sectional view of a preferred embodiment of the entire punch assembly of the present invention including the stripper spring assembly of FIG. 1 attached to a punch.

The punch assembly of the present invention is particularly useful in a high speed turret type punching device. As illustrated in FIG. 3, the punching device includes a ram (not shown), a punch assembly 11, a die 17, and a workpiece 21 inserted between the punch assembly 11 and the die 17. The ram imparts a downward force to the punch 44 to punch the workpiece with the punching end 46 of the punch 44. The punch 44 is slidably engaged about its punching end by a punch guide 52 which is in turn engaged by a lifting device 13 shown in phantom. The lifting device 13 provides a reactive upward force when the head 12 of the unitary stripper spring assembly 10 is struck by the ram to drive the punch 44 downward. The lifting device 13 is equipped with suitable springs (not shown) to lift the punch assembly and lifting device clear of the workpiece after a punching stroke. The lifting device 13 forms no part of the present invention and will not be discussed further.

Figure 1:
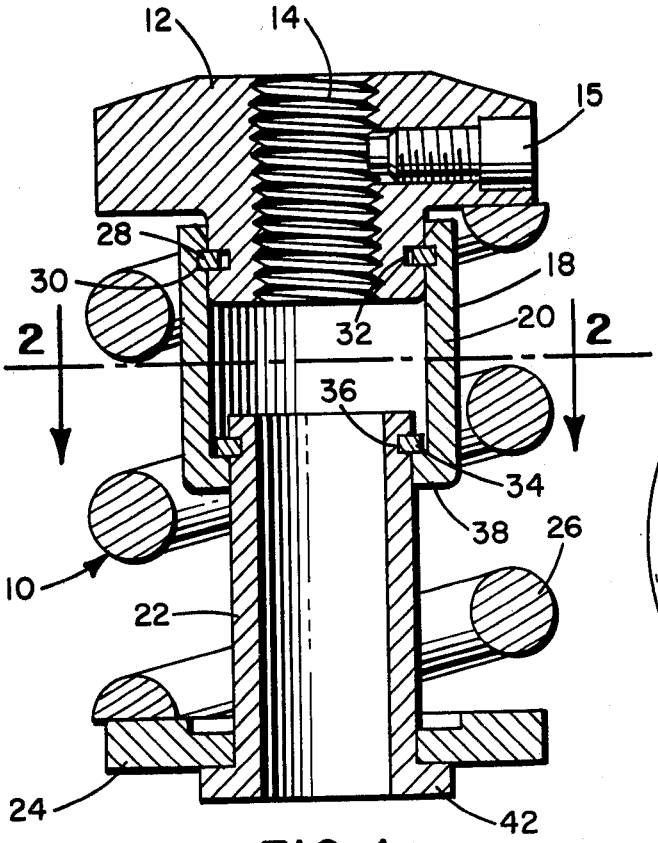
FIG. 1 is a longitudinal sectional view of a preferred embodiment of the unitary stripper spring assembly of the present invention.
Figure 2:
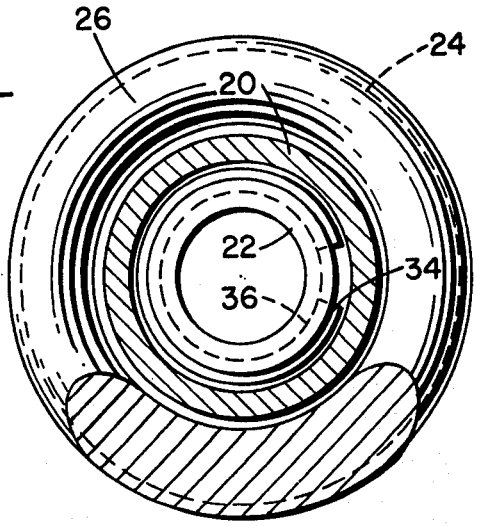
FIG. 2 is a sectional view taken along the lines 2—2 of FIG. 1.

The preferred embodiment of the punch assembly 11 of the present invention comprises three elements: a unitary stripper spring assembly 10, a punch 44, and a punch guide 52. As shown in FIG. 1, the unitary stripper spring assembly is a single integral unit that is fastened together independently of the punch 44 or other external fastening elements. The unitary stripper spring assembly 10 comprises a head 12, a washer 24, a stripper spring 26 mounted between the head 12 and the washer 24, and a telescopic retainer 18 interlinking the head and washer. Telescopic retainer 18 contracts in response to a force exerted on the head 12 to permit compression of the stripper spring 26. The telescopic retainer 18 includes an upper retainer 20 and a lower retainer 22.

The head 12 includes threads 14 which adjustably fasten the unitary stripper spring assembly 10 to the threaded fastening end of punch 44. The head 12 also includes a set screw 15, which locks the unitary stripper spring assembly 10 on punch 44 after adjustment of the position of the punch. The head 12 also includes an upper retainer ring 28 for fastening the upper retainer 20 of the telescopic retainer 18 to the head. The upper retainer ring 28 is seated in matching grooves for locking the upper retainer 20 and head 12 together, that is, upper retainer 20 includes groove 30 and head 12 includes groove 32. The upper retainer 20 and the head 12 are press fitted together.

Figure 7:
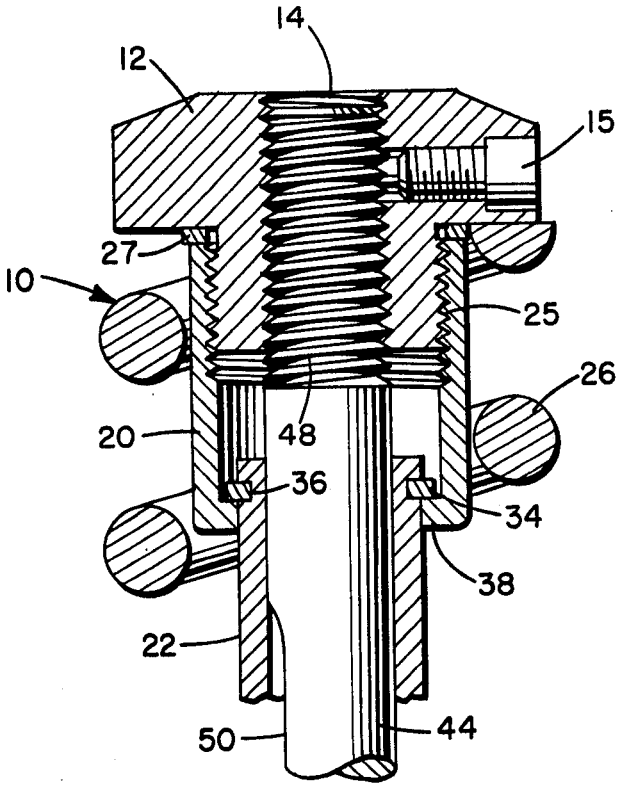
FIG. 7 is a vertical longitudinal sectional view of an alternative embodiment of the stripper spring assembly and punch of the present invention.
Figure 6:
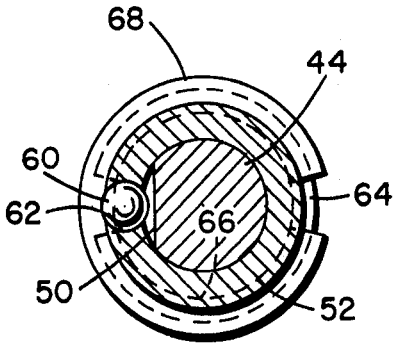
FIG. 6 is a sectional view taken along the lines 6—6 of FIG. 5.

Alternatively, as illustrated in FIG. 7, the head 12 and the upper retainer 20 are fastened together by matching threads 25 and lock washer 27 or other suitable locking device. Preferably, the lock washer 27 is a serrated lock washer.

Referring again to FIG. 1 lower retainer 22 and upper retainer 20 slide relative to one another like a telescope. Lower retainer 22 reciprocates axially within the larger upper retainer 20. The amount of reciprocation is limited by the bottom of the head 12 in one direction and by lower retainer ring 34 in the other direction. The lower retainer ring 34 is seated in groove 36 and this lower retainer ring abuts the upper surface of lip 38, which is at the bottom end of the upper retainer 20.

A washer 24 is placed on the flange 42 on the lower end of lower retainer 22. The lip 42 has a larger diameter than the bottom surface washer 24 so the washer 24 is slidably attached over the upper end of lower retainer 22 to assemble the unitary stripper spring assembly 10.

Stripper spring 26 is positioned between the head 12 and washer 24 before the telescopic retainer 18 and the head 12 are fastened together. The stripper spring 26 is pretensioned or preloaded with a predetermined amount of force to hold washer 24, telescopic retainer 18, and head 12 firmly in place. The pretensioning of stripper spring 26 also prevents the spring 26 from completely relaxing after a punching stroke, to control the amount of flexing of the stripper spring and thereby increase its useful life. In addition, pretensioning stripper spring 26 substantially reduces vibration of the punch assembly during use which also increases the useful life of the punch assembly and reduces maintenance cost.

Figure 4:
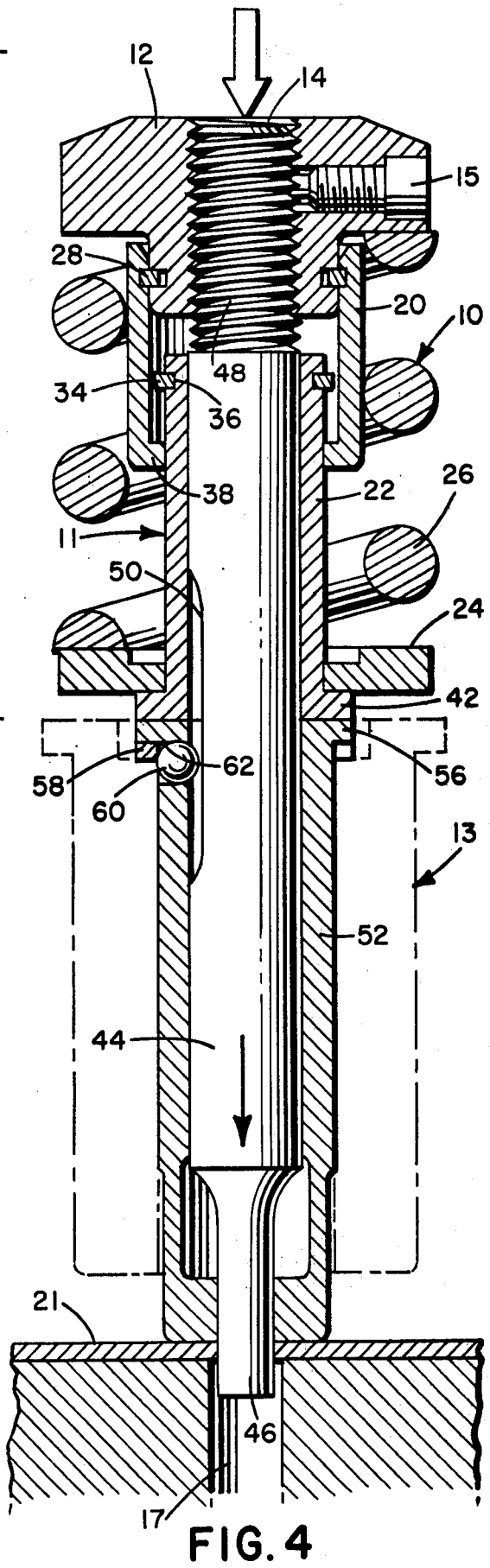
FIG. 4 is the punch assembly of FIG. 3 shown in operation.

The punch 44 of the stripper spring assembly 10 is illustrated in FIGS. 3 and 4. The punch 44 comprises a substantially cylindrical shaft having a punching end 46 and a fastening end 48. The punch 44 has a detent 50 for retaining a punch guide on the lower portion of the punch. In the preferred embodiment, the punching end 46 has a circular cutting surface of smaller diameter than the punch shaft. The punching end 46 cooperates with a die 17 of similar shape below a workpiece 21. Naturally, punches, punch guides, and dies may be constructed to punch holes of non-circular shape without departing from the spirit and scope of the present invention.

In the preferred embodiment illustrated in FIG. 3, the detent 50 in punch 44 comprises a substantially flat elongated detent intermediate the ends of the punch 44. The detent 50 may be formed by milling, grinding, or the like. Detent 50 cooperates with the punch guide 52 to retain the punch guide about the punch when the punch assembly is removed from the lifting device, but does not interfere with the reciprocal motion of the punch 44 during use.

The preferred embodiment of the punch guide 52 is shown in FIGS. 3 and 4 as a cylinder slidably attached over the lower end of punch 44 in a closely fitting relationship. Punch guide 52 includes a retaining device to retain the punch guide on the punch 44. The retaining device includes a flange 56 which is an integral part of punch guide 52, an annular retaining ring 58 placed on the outside surface of the punch guide 52 adjacent collar 56, and a ball 60 seated in an aperture 62. The ball 60 is retained in aperture 62 through the wall of punch guide 52 by peening the interior surface of aperture 62. The ball is held in position in the aperture 62 on the outside by contact with annular retaining ring 58. Annular retaining ring 58 is in turn held in place by the collar 56 which abuts the ring 58. Ball 60 rides in detent 50 on the punch 44 to permit free reciprocal motion of punch 44 within the limits established by the length of detent 50. Unintentional detachment of the punch guide 52 from the punch 44 is prevented, but the punch guide 52 can be manually removed from punch 44 with ease.

Figure 5:
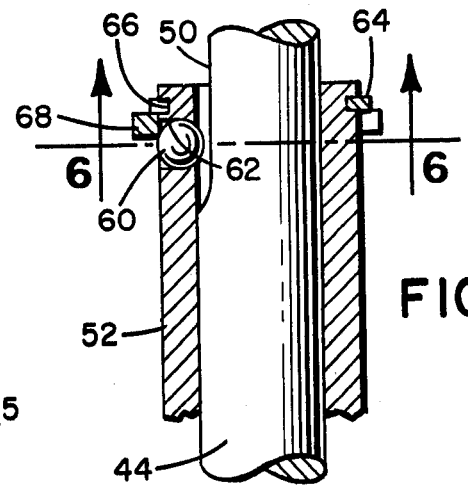
FIG. 5 is the sectional view of an alternative embodiment of a punch guide of the present invention.

An alternative embodiment of the punch guide 52 is illustrated in FIG. 5. A first retaining ring 64 is seated in circumferential groove 66. The ball 60 then is held in aperture 62 by a second retaining ring 68 which is held in place by a tightly abutting relationship with the first retaining ring 64. The second retaining ring 68 is placed on the outside surface of the punch guide 52.

Although operation of the punch assembly of the present invention is apparent from the above discussion, a brief description of the operation is given below, with reference to FIGS. 3 and 4. The punch assembly can be used in modern punch presses and is particularly useful in automatic turret type punch presses. The punch assembly 11, including the lifting device 13 surrounding the lower end of the punch and punch guide, is placed into a suitable holder in a punch press. A ram (not shown) strikes the top of the head 12 forcing the head downwardly as shown in FIG. 4. The downward force pushes the punch guide 52 against the workpiece 21, and the lifting device provides a reactive force which permits the punch to continue its downward motion independent of further motion by the lifting device. This motion compresses stripper spring 26 and forces punch 44 through the workpiece 21 into the cooperating die below. When the ram is lifted from the head 12 of the punch assembly 11, stripper spring 26 expands and strips the workpiece 21 from the punch 44. Additional springs (not shown) attached to the lifting device 13 then raise the punch assembly free of the workpiece 21, permitting the workpiece to be relocated in preparation for the next punching stroke. Since the foregoing steps are conventional, the punch assembly 11 of the present invention remains compatible with existing punch presses.

After a period of use, the punching end 46 of punch 44 becomes dull and must be sharpened by grinding. Punch assembly 11 is readily removed from lifting device 13. The punch guide 52 is manually removed from punch 44, thus exposing punching end 46 for sharpening. Sharpening of the punch 44 typically removes approximately 1/16th of an inch from the punching end of the punch. Since sharpening shortens the punching end 46 and causes the punch 44 to recess in the punch guide 52, the length of the punch from the stripper spring assembly to the punching end must be adjusted.

The punch 44 of the present invention can be readily adjusted so that punching end 46 is flush with the bottom of punch guide 52, its optimal position, even after repeated sharpening. Adjustment is readily achieved by loosening set screw 15 and rotating punch 44 relative to unitary stripper spring assembly 10, which can be done by hand. To lock punch 44 into its newly adjusted position, set screw 15 is tightened against the threaded fastening end 48 of punch 44. Punch 44 is not otherwise fastened or attached to unitary stripper spring assembly 10, but is stablized and guided by lower retainer 22 of the telescopic retainer 18 as well as by punch guide 52.

In addition to the proximity of punching end 46 to the bottom of punch guide 52, the distance between the top of head 12 and bottom of lower retainer 22, that is, the distance X in FIG. 3 is important. The distance X determines the amount of tension on stripper spring 26, which is an important factor in its useful life. The distance X also determines the distance between the top of head 12 and the ram (not shown). This latter distance must be minimized to lessen the time required for a punching stroke and to lessen the impact on the punch assembly. The unitary stripper spring assembly of the present invention provides a constant distance X so only one simple, readily performed adjustment, which is continuous rather than discrete, can be made to establish and maintain the optimal position of punch 44 and head 12.

While preferred embodiments of the present invention have been disclosed, it will be appreciated that modifications of the disclosure may be made by those skilled in the art without departing from the spirit and scope of the present invention, which should be determined by the following claims.

I claim:

1. A punch assembly for punching a workpiece comprising:

a punch having a punching end, a fastening end, and a detent intermediate said punching and fastening ends;

a unitary stripper spring assembly fastenable to said fastening end of said punch to remove said punch from said workpiece, said unitary stripper spring assembly including a stripper spring, a head adjustably fastenable to said fastening end of said punch, a washer, said stripper spring being mounted between said head and said washer, and a telescopic retainer having an upper retainer and a lower retainer in reciprocal slidable relationship to one another, said telescopic retainer interlinking said head and said washer and responsive to a force exerted on said head for allowing said unitary stripper spring assembly to contract, and fastening means for adjustably fastening said unitary stripper assembly on said fastening end of said punch, said stripper spring and said fastening means being coupled together so that said stripper spring and said fastening means are separable from said punch as a unit; and punch guide means encircling said punching end of said punch for guiding said punch toward said workpiece, said punch guide means including retaining means coactive with said detent on said punch for retaining said punch guide means on said punch.

2. A punch assembly in accordance with claim 1 wherein said fastening end of said punch is threaded and said fastening means of said unitary stripper spring assembly comprises said head, said head being threaded for attachment to said fastening end of said punch, the position of said unitary stripper spring assembly being adjustable on said fastening end of said punch by turning said threaded head.

3. A punch assembly in accordance with claim 2 wherein said fastening means further comprises locking means for locking said head on said fastening end of said punch after adjustment of said unitary stripper spring assembly on said fastening end of said punch.

4. A punch assembly in accordance with claim 3 wherein said locking means comprises a set screw.

5. A punch assembly in accordance with claim 1 wherein said punch guide means comprises an elongated cylinder, an integral collar on the upper end of said cylinder, an aperture through said cylinder adjacent said integral collar, an annular retaining ring abutting said collar and covering at least a portion of said aperture, and a ball disposed in said aperture, said ball being held within said aperture by said annular retaining ring.

6. A punch assembly in accordance with claim 1 wherein said punch guide comprises an elongated cylinder with a circumferential groove on the upper end of said cylinder, an aperture through said cylinder adjacent but not contiguous with said circumferential groove, a first retaining ring disposed within said circumferential groove, a second retaining ring abutting said first retaining ring and covering at least a portion of said aperture, and a ball disposed in said aperture, said ball being held within said aperture by said second retaining ring.

7. A punch assembly in accordance with claim 5 or 6 wherein said detent is a substantially flat elongated detent and said ball cooperates with said detent for retaining said punch guide on said punch.

8. A punch assembly for punching a workpiece comprising:

a punch having a punching end and a fastening end;

a unitary stripper spring assembly fastenable to said fastening end of said punch to remove said punch from said workpiece, said unitary stripper spring assembly including a stripper spring, a head adjustably fastened to said fastening end of said punch, a washer, said stripper spring being mounted between said washer and said head, and a telescopic retainer having an upper retainer and a lower retainer in reciprocal slidable relationship to one another, said telescopic retainer interlinking said head and said washer and responsive to a force exerted on said head for allowing said unitary stripper spring assembly to contract, and fastening means for adjustably fastening said unitary stripper spring assembly on said fastening end of said punch, said stripper spring and said fastening means being coupled as a unit so that said unitary stripper spring assembly is separable from said punch.

9. A punch assembly in accordance with claim 8 wherein said fastening end of said punch is threaded and said fastening means of said unitary stripper spring assembly comprises a threaded head attachable to said fastening end of said punch, the position of said unitary stripper spring assembly being adjustable on said fastening end of said punch by turning said threaded head.

10. A punch assembly in accordance with claim 9 wherein said fastening means further comprises locking means for locking said threaded head on said fastening end of said punch after adjustment of said unitary stripper spring assembly on said fastening end of said punch.

11. A punch assembly in accordance with claim 10 wherein said locking means comprises a set screw.

12. A punch assembly in accordance with claim 8 wherein said lower retainer is slidably retained within said upper retainer.

13. A punch assembly in accordance with claim 8 wherein said upper retainer is fastened to said head, said upper retainer comprising limiting means for limiting movement of said lower retainer relative to said upper retainer.

14. A punch assembly in accordance with claim 13 wherein said upper retainer is screwed on said head.

15. A punch assembly in accordance with claim 14 wherein said upper retainer is secured to said head by a lock washer.

16. A punch assembly in accordance with claim 8 wherein said upper retainer and said head include matching grooves and said telescopic retainer further comprises an upper retainer ring seated in said matching grooves for press fitting said upper retainer on said head.

17. A punch assembly in accordance with claim 12 or 16 wherein said lower retainer comprises stop means cooperative with said upper retainer for stopping axial movement of said lower retainer relative to said upper retainer and washer fastening means for fastening said washer on said lower retainer.

18. A punch assembly in accordance with claim 17 wherein said lower retainer includes a groove and said telescopic retainer comprises a lower retainer ring seated in said groove for stopping movement of said lower retainer relative to said upper retainer.

19. A punch assembly in accordance with claim 17 wherein said washer fastening means comprises a lip.

20. In a punch assembly having a punch with a threaded end and a punching end, a unitary stripper spring assembly to remove said punch from a workpiece comprising:

a threaded head attachable to said threaded end of said punch, the position of said unitary stripper spring assembly being adjustable on said threaded end of said punch by turning said threaded head;

a washer;

a stripper spring mounted between said head and said washer, said stripper spring being responsive to a contractive force exerted on said spring during punching of said workpiece to remove said punch from said workpiece; and a telescopic retainer having an upper retainer and a lower retainer in reciprocal slidable relationship to one another, said telescopic retainer interlinking said head and said washer for enabling said unitary stripper spring assembly to contract in response to a force exerted on said head during punching of said workpiece.

21. A unitary stripper spring assembly for removing a punch from a workpiece, said punch having a threaded end and a punching end, said unitary stripper spring assembly comprising:

a threaded head attachable to said threaded end of said punch, the position of said unitary stripper spring assembly being adjustable on said threaded end of said punch by turning said threaded head;

a washer;

a stripper spring mounted between said head and said washer, said stripper spring being responsive to a contractive force exerted on said spring during punching of said workpiece to remove said punch from said workpiece; and a telescopic retainer having an upper retainer and a lower retainer in reciprocal slidable relationship to one another, said telescopic retainer interlinking said head and said washer for enabling said unitary stripper spring assembly to contract in response to a force exerted on said head during punching of said workpiece.

* * * * *